US005862757A

United States Patent [19]

Hauck

[11] Patent Number: 5,862,757

[45] Date of Patent: Jan. 26, 1999

[54] METHOD AND DEVICE FOR ELIMINATING RHYTHMIC REGISTER ERRORS IN SHEET-FED PRINTING MACHINES WITH MULTIPLE-SIZE CYLINDERS

[75] Inventor: Axel Hauck, Karlsruhe, Germany

[73] Assignee: Heidelberger Druckmaschinen Aktiengesellschaft, Heidelberg, Germany

[21] Appl. No.: 851,019

[22] Filed: May 5, 1997

[30] Foreign Application Priority Data

May 4, 1996 [DE] Germany ..... 196 18 029.5

[51] Int. Cl.[6] ..... B41F 1/54; B41F 13/24

[52] U.S. Cl. ..... 101/484; 101/232; 101/409

[58] Field of Search ..... 101/484, 486, 101/181, 183, 230, 231, 232, 233, 248, 409, 408; 271/3.24, 82

[56] References Cited

U.S. PATENT DOCUMENTS

| | | | |
|---|---|---|---|
| 3,724,368 | 4/1973 | Treff | 101/247 |
| 3,992,993 | 11/1976 | Kühn et al. | 101/409 |
| 4,052,055 | 10/1977 | Jiruse et al. | 101/409 |
| 4,357,870 | 11/1982 | Rudolph et al. | 101/409 |
| 4,856,426 | 8/1989 | Wirz | 101/230 |
| 5,040,460 | 8/1991 | Stark | 101/232 |
| 5,076,165 | 12/1991 | Pollich | 101/408 |
| 5,110,109 | 5/1992 | Stanco et al. . | |
| 5,215,014 | 6/1993 | Burger et al. . | |
| 5,335,597 | 8/1994 | Helmstädter | 101/183 |
| 5,390,601 | 2/1995 | Fricke et al. . | |
| 5,431,099 | 7/1995 | Maass et al. . | |
| 5,456,128 | 10/1995 | Thünker | 101/409 |
| 5,524,538 | 6/1996 | Voge et al. | 101/183 |
| 5,596,929 | 1/1997 | Fricke et al. | 101/232 |

FOREIGN PATENT DOCUMENTS

| | | |
|---|---|---|
| 2 200 530 | 8/1972 | Germany . |
| 76 09 529 U1 | 4/1978 | Germany . |
| 28 20 619 C2 | 3/1986 | Germany . |
| 40 13 261 C1 | 6/1991 | Germany . |
| 41 10 035 A1 | 10/1992 | Germany . |
| 42 00 406 A1 | 7/1993 | Germany . |
| 42 21 929 A1 | 1/1994 | Germany . |
| 42 33 867 A1 | 4/1994 | Germany . |
| 44 03 673 A1 | 8/1995 | Germany . |
| 44 06 740 A1 | 9/1995 | Germany . |
| 1 334 195 | 10/1973 | United Kingdom . |
| 2 263 105 | 7/1993 | United Kingdom . |

*Primary Examiner*—Eugene H. Eickholt
*Attorney, Agent, or Firm*—Herbert L. Lerner; Laurence A. Greenberg

[57] ABSTRACT

A method for eliminating a rhythmic register error in a sheet-fed printing machine with a multiple-size sheet-conveying cylinder having at least one first and one second gripper device includes varying instants of closure of the gripper devices by adjusting adjusting devices assigned to the gripper devices so as to compensate for the register error; and a device for performing the foregoing method.

12 Claims, 5 Drawing Sheets

METHOD AND DEVICE FOR ELIMINATING RHYTHMIC REGISTER ERRORS IN SHEET-FED PRINTING MACHINES WITH MULTIPLE-SIZE CYLINDERS

BACKGROUND OF THE INVENTION

1. Field of the Invention

The invention relates to a process and a device for eliminating rhythmic register errors in sheet-fed printing machines with multiple-size cylinders, more particularly, multiple-size sheet-conveying cylinders having at least one first and one second gripper device.

In printing machines, in particular in the case of sheet-fed printing machines with multiple-size cylinders, for example double-size or triple-size impression or transfer cylinders, it can be observed in practice that, depending upon the printing job, the composition of the paper and the printing speed, rhythmic errors occur in the sheet transfer from an upstream cylinder to a downstream cylinder, which lead to so-called "ghosting" and which are referred to hereinbelow as rhythmic register errors. The register errors are caused, for example, by differences occurring in the gripper setting and in the gripper pad height of the gripper devices as a result of production or installation tolerances of the components, and these differences can lead to the shifting of grippers, to errors during sheet transfer and to different retaining forces, as a result of which the position of the transferred sheet changes in the gripper device which accepts it. Because this change in the sheet length occurs, respectively, only at one gripper device in the case of double-size or multiple-size cylinders, i.e., cylinders having two, three or more gripper devices, the register errors caused in this way are correspondingly to be seen only on each second, third and so forth sheet. Furthermore, the aforedescribed rhythmic register errors or register changes can also be caused by pitch errors or eccentricities of the drive gear wheels of the printing machine.

Register changes of this type are eliminated in the final installation or assembly of the printing machine by a complicated and deliberate correction of the respective components.

SUMMARY OF THE INVENTION

It is accordingly an object of the invention to provide a method for eliminating rhythmic register errors in sheet-fed printing machines with double-size or multiple-size cylinders, with which the rhythmic register changes can be eliminated by the pressman through the use of relatively simple technical operations and in a relatively simple, cost-effective manner, in particular, during a running print job with the printing machine in operation. Furthermore, it is an object of the invention to provide a device for performing the method which permits simple, cost-effective and deliberate correction of rhythmic register changes by the pressman in all of the operating states of a printing machine.

With the foregoing and other objects in view, there is provided, in accordance with one aspect of the invention, a method for eliminating a rhythmic register error in a sheet-fed printing machine with a multiple-size sheet-conveying cylinder having at least one first and one second gripper device, which comprises varying instants of closure of the gripper devices by adjusting adjusting devices assigned to the gripper devices so as to compensate for the register error.

In accordance with another mode, the method of the invention includes respectively advancing and retarding the instant of closure of the gripper device, which causes the register error, in relation to a predetermined instant of closure offset value.

In accordance with a further mode, the method of the invention includes locating the instant of closure offset value ahead of the gripper center line of the sheet-conveying cylinder and an upstream sheet-conveying cylinder.

In accordance with an added mode, the method of the invention includes locating the instant of closure offset value behind the gripper center line of the sheet-conveying cylinder and an upstream sheet-conveying cylinder.

In accordance with an additional mode, the method of the invention includes, in the case of a leading sheet, respectively advancing and retarding the instant of closure of the gripper device causing the register error by adjusting the adjusting device assigned to the gripper device, in such a manner that compensation for the register error is effected and, in the case of a lagging sheet, respectively advancing and retarding the instant of closure of the remaining gripper devices by adjusting the adjusting devices assigned thereto, in such a manner that compensation for the register error is up achieved.

In accordance with yet another mode, the method of the invention includes performing the adjustment of the instant of closure during the operation of the printing machine.

In accordance with yet a further mode, the method of the invention includes performing the adjustment of the instants of closure during start-up of the printing machine automatically in predeterminable operating states of the printing machine.

In accordance with yet an added mode, the method of the invention provides for the adjusting devices to contain cam disks rotatable manually and/or by motor, the adjustment of the instant of closure being performed by rotating the cam disks.

In accordance with yet an additional mode, the method of the invention provides for performing the adjustment of the instant of closure by varying positions of stops of the gripper devices.

In accordance with another aspect of the invention, there is provided a method for eliminating rhythmic register errors in sheet-fed printing machines with a multiple-size sheet-conveying cylinder having at least one first and one second gripper device, which includes varying closing forces of the gripper devices so that compensation for the register error is achieved.

In accordance with a further aspect of the invention, there is provided a device for eliminating rhythmic register errors in sheet-fed printing machines with a multiple-size sheet-conveying cylinder having at least one first and one second gripper device, comprising a first cam disk assigned to the first gripper device and being rotatable by a first actuating device, and a second cam disk assigned to the second gripper device and being rotatable by a second actuating device.

In accordance with another feature of the invention, the actuating devices are formed as motorized adjusting devices, and the printing machine has a central control device for controlling the first and/or second actuating device.

In accordance with a further feature of the invention, the cam disks are arranged on the same side of the sheet-conveying cylinder of the printing machine.

In accordance with a concomitant and alternative feature of the invention, the cam disks are arranged on mutually opposite sides of the sheet-conveying cylinder of the printing machine.

The method according to the invention has the particular advantage that it may be performed even when, in the case of printing machines, they are already in operation after performing slight modifications, and that it is also possible to eliminate even such rhythmic register changes effectively as, for example, occur exclusively in quite specific materials to be printed, thicknesses of materials to be printed, formats of materials to be printed, and so forth, or else exclusively when starting up the printing machine in a quite specific speed range.

Other features which are considered as characteristic for the invention are set forth in the appended claims.

Although the invention is illustrated and described herein as embodied in a process and device for eliminating rhythmic register errors in sheet-fed printing machines with multiple-size cylinders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
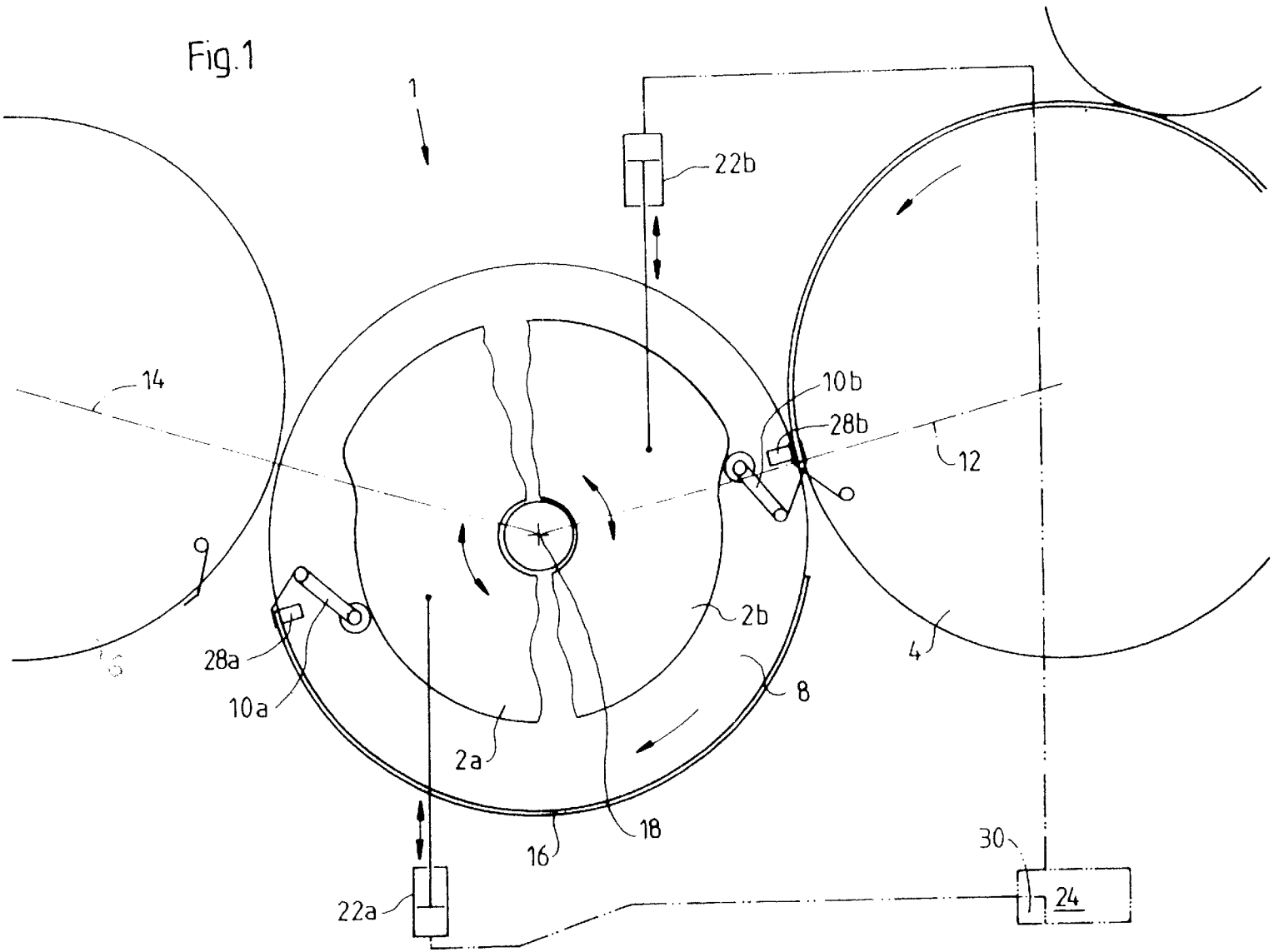
FIG. 1 is a diagrammatic and schematic side elevational view of a device according to the invention which is arranged on a transfer cylinder of a sheet-fed rotary offset printing machine.

Referring now to the drawings and, first, particularly to FIG. 1 thereof, there is shown therein the device 1 for eliminating rhythmic register changes which includes a first cam disk 2*a* and a second cam disk 2*b*, which are arranged on a transfer drum 8 located between a first upstream impression cylinder 4 and a second downstream impression cylinder 6 of a sheet-fed printing machine, not shown in greater detail. In the case of the exemplary embodiment of the invention illustrated in FIGS. 1 and 2, the transfer drum or transfer cylinder 8 is constructed as a so-called double-size cylinder, which means that its circumference has a diameter which is twice as large as the printing plate cylinder used in the printing machine. However, the use of the device 1 according to the invention is not restricted to a double-size cylinder but can also be employed in the case of a multiple-size cylinder or drum 8, for example, a triple-size or quadruple-size drum.

Figure 2:
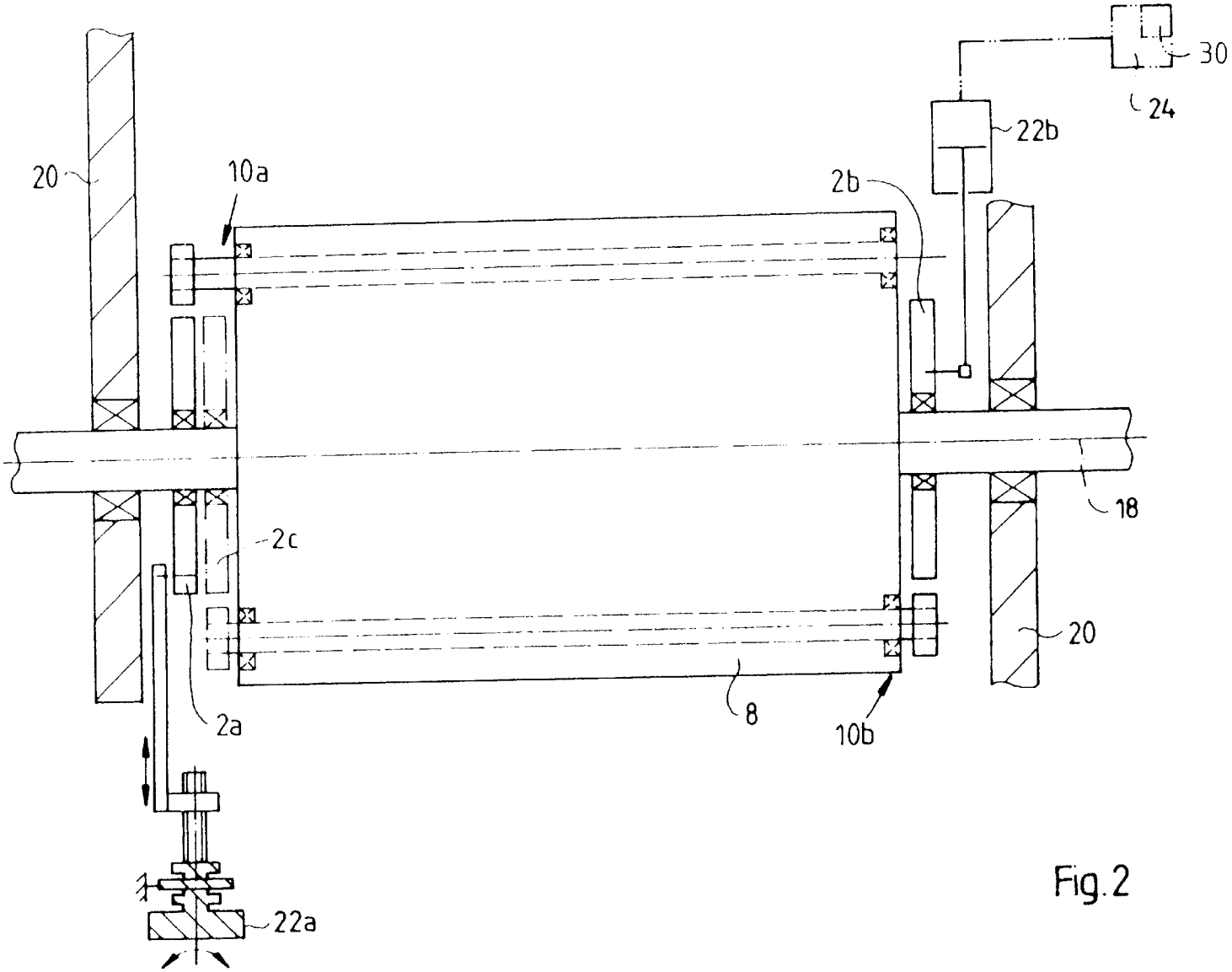
FIG. 2 is a diagrammatic and schematic cross-sectional view of a printing machine cylinder according to FIG. 1 which is provided with the device according to the invention, and wherein control cams for gripper devices are arranged on mutually opposite sides of the printing machine cylinder (solid lines) or on the same side of the printing machine cylinder (broken lines)

The cam disks 2*a* and 2*b* have corresponding gripper devices 10*a* and 10*b*, respectively, assigned thereto, which are actuated by the respective cam disks 2*a* and 2*b* in a conventional manner, via roller levers, not otherwise illustrated in greater detail, in the region of the gripper center line 12 of the transfer drum 8 and of the upstream impression cylinder 4 and, respectively, the gripper center line 14 of the transfer drum 8 and of the downstream impression cylinder 6, for the purpose of accepting or transferring a sheet 16 from the upstream impression cylinder 4 to the downstream impression cylinder 6. The cam disks 2*a* and 2*b* in the embodiment of the invention illustrated in FIGS. 1 and 2 are mounted so that they can rotate with respect to the axis of rotation 18 of the transfer drum 8, the cam disks 2*a* and 2*b* being substantially fixedly arranged with respect to the side walls 20 of the printing machine, as illustrated in FIG. 2, during a rotation of the transfer drum 8. In order to adjust the respective cam disk 2*a*, 2*b*, corresponding actuating devices 22*a* and 22*b* are provided, as shown in FIGS. 1 and 2, which can be constructed, for example, as an adjusting device which can be actuated manually via a hand lever or a setting screw, or as a pneumatic and/or electric adjusting device, or in any another conventional manner. In the preferred embodiment of the invention, the adjustment of the cam disks 2*a* and 2*b*, in the case wherein an electric and/or pneumatic adjusting device or actuating device 22*a*, 22*b* is used, is preferably performed by the central control device 24 of the printing machine, which is illustrated diagrammatically and schematically in FIG. 1 by broken lines.

As shown in FIG. 2, the cam disks 2*a* and 2*b* can be arranged either on mutually opposite sides of the transfer drum 8 (solid lines) or located alongside one another on one side of the transfer drum 8, as is illustrated diagrammatically, for example, by the broken lines 2*c* in FIG. 2. The arrangement of the two cams disks 2*a* and 2*b* on one side of the transfer drum 8 has the advantage that dynamic changes during the closing and opening of the gripper devices 10*a* and 10*b*, which can occur for example as a result of a known torsion or twisting of the gripper shafts, are substantially identical because of the symmetrical introduction of the forces into the two gripper shafts for the two gripper devices 10*a* and 10*b*.

Figure 3:
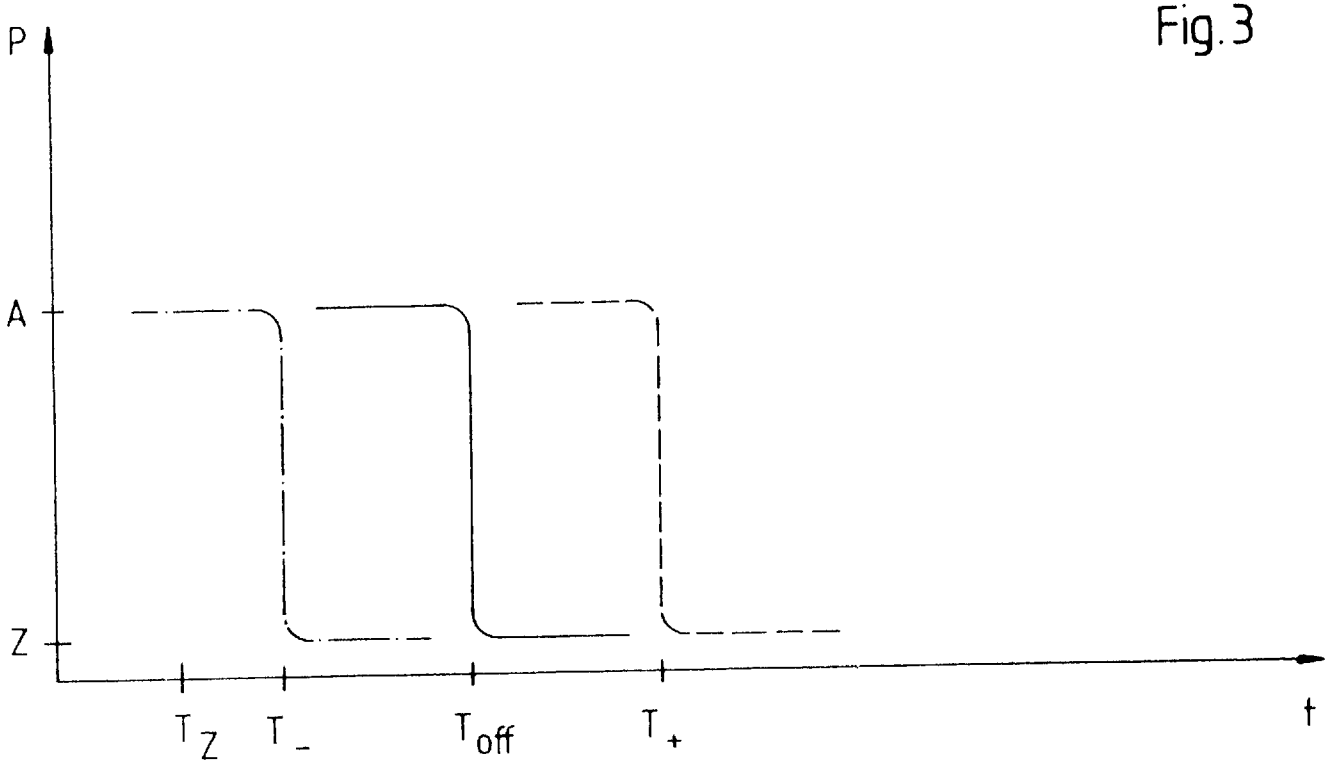
FIG. 3 is a plot diagram depicting the displacement of the closing times of the gripper device in relation to a predetermined offset value drawn behind the gripper center line.
Figure 4A:
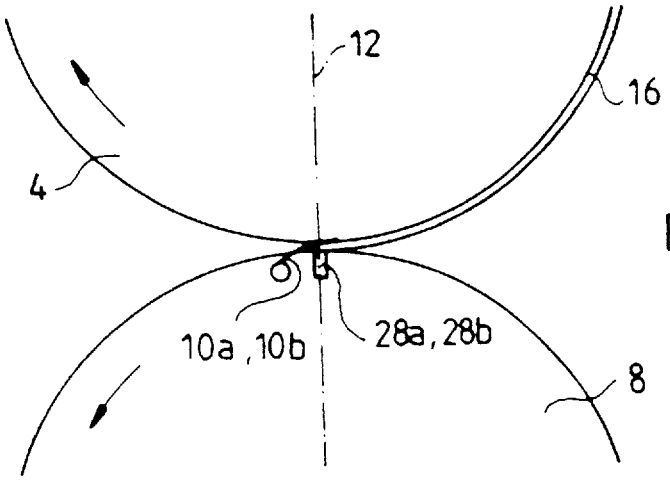
FIG. 4*a* is a diagrammatic and schematic cross-sectional view of an upstream and a downstream printing unit cylinder, wherein the instant of closure of the gripper device of the downstream cylinder lies on the gripper center line.
Figure 4B:
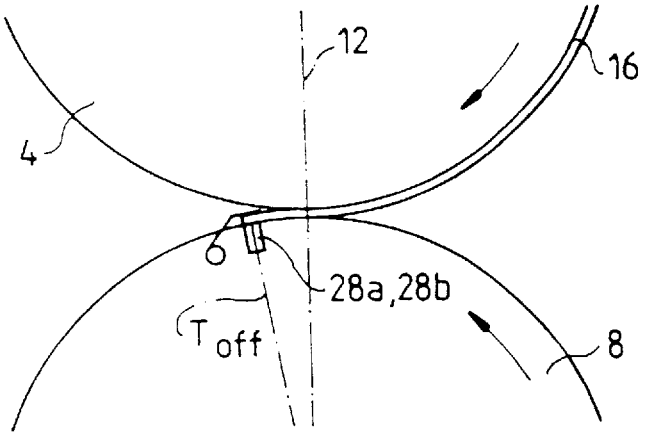
FIG. 4*b* is another view of FIG. 4*a*, wherein the instant of closure of the gripper device of the downstream cylinder is retarded by an offset value with respect to the gripper center line.
Figure 4C:
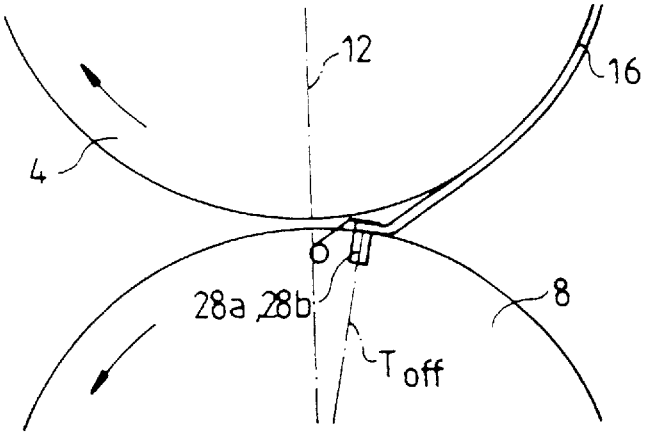
FIG. 4*c* is a further view of FIGS. 4*a* and 4*b*, wherein the instant of closure of the gripper device of the downstream cylinder is advanced by an offset value with respect to the gripper center line.

Mode of operation:

By adjusting the gripper devices 10*a* and 10*b* with the actuating devices 22*a* and 22*b*, a displacement of the instant of closure T of the respective gripper device 10*a*, 10*b* during the transfer of a sheet 16 from the gripper device of the upstream impression cylinder 4 is performed. As is shown in FIG. 4*a*, the closing of the gripper devices 10*a* and 10*b* normally takes place directly on the gripper center line 12, the leading edge of the printed sheet 16 resting flat on the respective gripper pad 28*a*, 28*b* of the corresponding gripper device 10*a*, 10*b* at the instant of closure Tz (note FIG. 3, wherein the gripper opening position P is plotted against the time t or the angular position of the printing machine). In FIG. 3, A denotes the position of the grippers in the opened state and Z the position of the grippers in the closed state. If, as shown in FIGS. 4*b* and 4*c*, the instants of closure of the gripper devices 10*a* or 10*b* are advanced or retarded ($T_{off}$) by rotating the corresponding cam disks 2*a* and 2*b*, then a gap is produced between the sheet 16 and the respective pads 28*a* and 28*b* of the gripper devices, as a result of which the sheet 16 comes slightly out of the grippers of the gripper devices 10*a* and 10*b*, in terms of the position thereof, and the sheet position is accordingly displaced or set back. The set-back of the sheet in the gripper devices 10*a* and 10*b* leads to the printed image on the sheet 16 being displaced towards the sheet leading edge in the following non-illustrated printing units. Because the displacement of the printed image towards the sheet leading edge, starting from the instant of closure Tz on the gripper center line 12, occurs both in the case of advancing the instant of closure Tz, as shown in FIG. 4*c*, and also in the case of retarding the instant of closure Tz, as shown in FIG. 4*b*, the instants of closure in the preferred embodiment of the device according to the invention, as shown in FIG. 3, for both gripper devices 10*a* and 10*b* are, from the outset, retarded by a predefinable offset value $T_{off}$ with respect to the moment of closure Tz in the gripper center line 12. In the same manner, an advancement, not illustrated in FIG. 3, of the instant of closure for all the gripper devices 10*a* and 10*b* by a predefinable offset value can also be performed. Starting from this offset value $T_{off}$, in order to compensate for a rhythmic register change which is occurring, the appropriate cam disk 2*a*, 2*b* of the gripper device 10*a*, 10*b* causing the register change is adjusted by the actuating devices 22*a* or 22*b* until compensation for the rhythmic register change or the rhythmic register error occurs. Starting from the offset value $T_{off}$, for example, an advancement of the instant of closure to the value T− (note FIG. 3) leads to a slight displacement of the printed image towards the sheet trailing edge, whereas a displacement of the instant of closure to the later value T+ in the following printing units leads to a slight displacement of the printed image towards the sheet leading edge. Thus, a rotation of the cam disks 2*a* and 2*b* through 3°, for example, leads to a change in sheet position of about 30 μm.

Therefore, if the pressman determines a rhythmic register error is being caused by an advancement of the sheet 16 in the first gripper device 10*a*, he or she then adjusts the associated cam disk 2*a* forward or back by a corresponding value T− or T+ until the register error no longer shows in the printed image. The advancement or retardation of the cam disks 2*a* and 2*b* can in this case preferably be performed during the running operation of the printing machine, for example, remotely controlled from the feeder, so that a correction of sudden rhythmic register errors can be performed by the pressman in a very short time and with comparatively little effort.

Furthermore, provision can be made that, in the case of print jobs wherein, for example, a rhythmic register error always occurs in a quite specific speed range of the printing machine, the central control device 24 of the printing machine even controls the actuating devices 22*a* and 22*b* in an appropriate manner from the beginning so that, in the speed range, a correction is already automatically performed from the start, without requiring intervention by the pressman at this point.

Figure 5:
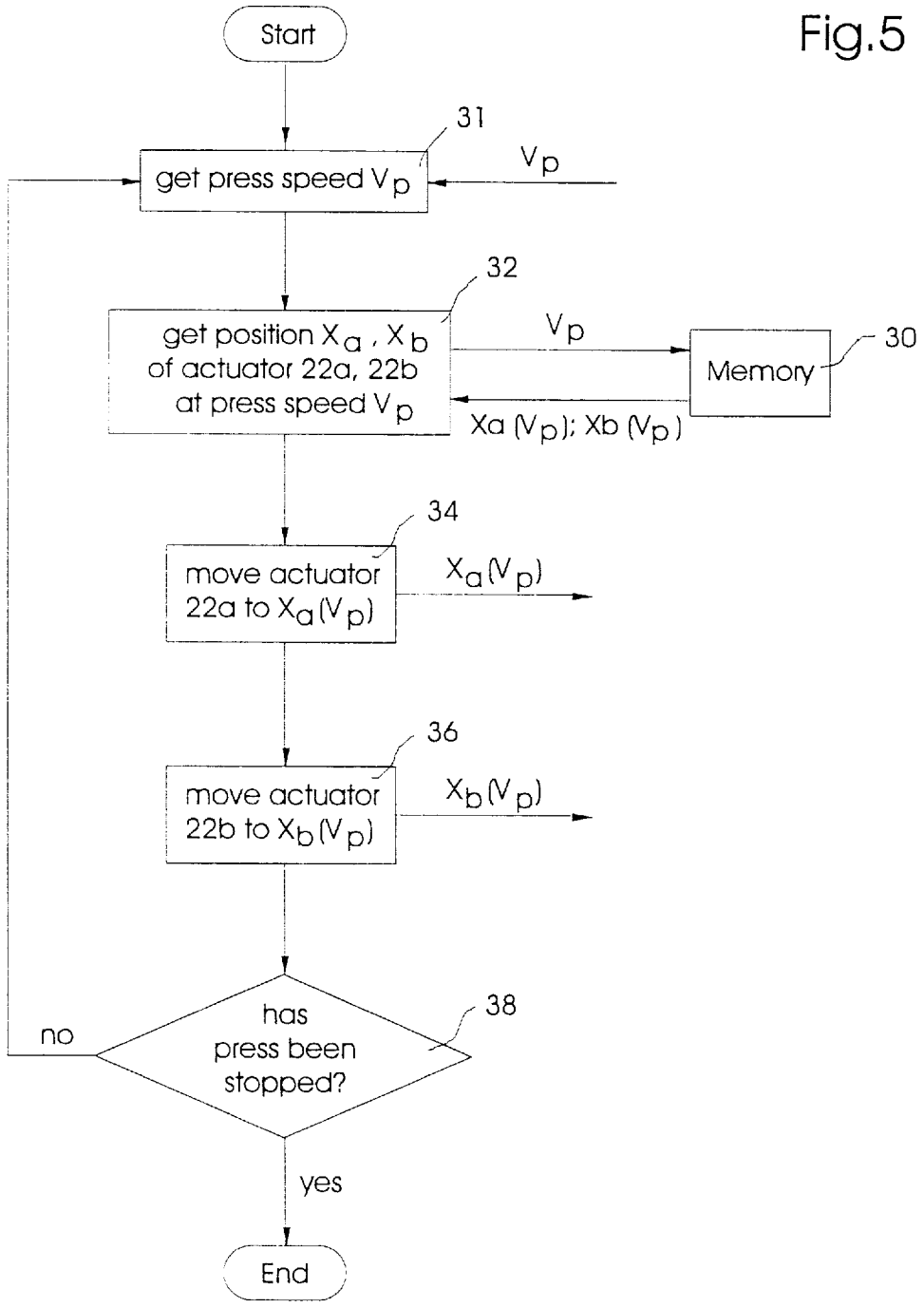
FIG. 5 is a flow chart of the operation of the central control device forming part of the device according to the invention.

Such a control can be effected, for example, in accordance with the flow chart shown in FIG. 5, wherein, in a first step 31, the instantaneous speed $V_P$ of the printing machine is queried by the control device 24 and, in a second step 32, the positions $X_a$ ($V_P$) and $X_P$ ($V_P$) belonging to the respective speed value $V_P$ of the actuating devices 22*a* and 22*b* are read from a memory 30. In a next step 34, the actuating device 22*a* is moved into the position $X_a$ ($V_P$), in a further step 36, the gactuating device 22*b* is moved into the position $X_b$ ($V_P$), and in connection therewith, in a step 38, the control device 24 is queried whether the printing machine has stopped. If it has stopped, the program represented by the flow chart is at an end, and, in case that no stop signal is present, the program is restarted at 31.

In the case of a further embodiment of the invention, provision can be made to perform the advancement or retardation of the instants of closure of the gripper devices 10*a* and 10*b* by adjusting the gripper stops, or to compensate for the register error by varying the closing forces of the corresponding gripper device 10*a*, 10*b*. This results, in the same manner, in an advancement or retardation of the sheet position in the gripper devices 10*a* and 10*b*.

In the case of yet another embodiment of the invention, provision can moreover be made that, instead of an advancement or retardation of the instant of closure T of the gripper device 10*a*, 10*b* causing the register error, starting from an offset value $T_{off}$, as previously described herein, the instant of closure of the gripper device causing the register error being maintained in the case of a lagging sheet 16, and in a corresponding way an adjustment of the moments of closure of the second gripper device or second gripper devices being undertaken for the purpose of correcting the sheet position and for the purpose of eliminating the register error in the case of a multiple-size, for example a triple-size, transfer drum 8. With regard to the case of a leading sheet, however, only the instant of closure of the gripper device causing the register error is varied, until compensation for the error is achieved.

Although the invention has been described hereinabove with reference to the time t at which the gripper devices close, it is readily apparent that, instead of the time t, the angular position of the printing machine can be used in the same manner.

I claim:

1. A method for eliminating a rhythmic register error in a sheet-fed printing machine with a multiple-size sheet-conveying cylinder having at least one first and one second gripper device, which comprises:

varying instants of closure of the gripper devices by adjusting adjusting devices assigned to the gripper devices so as to compensate for the register error; and respectively advancing and retarding the instants of closure of the gripper devices, which cause the register error, in relation to a predetermined instant of closure offset value.

2. The method as claimed in claim 1, which includes locating the instant of closure offset value ahead of a gripper center line of the sheet-conveying cylinder and an upstream sheet-conveying cylinder.

3. The method as claimed in claim 1, which includes locating the instant of closure offset value behind a gripper center line of the sheet-conveying cylinder and an upstream sheet-conveying cylinder.

4. The method as claimed in claim 1, which includes, in the case of a leading sheet, respectively advancing and retarding the instant of closure of the gripper device causing the register error by adjusting the adjusting device assigned to the gripper device, in such a manner that compensation for the register error is effected and, in the case of a lagging sheet, respectively advancing and retarding the instant of closure of the remaining gripper devices by adjusting the adjusting devices assigned thereto, in such a manner that compensation for the register error is achieved.

5. The method as claimed in claim 1, which includes performing the adjustment of the instant of closure during the operation of the printing machine.

6. The method as claimed in claim 5, which includes performing the adjustment of the instants of closure during start-up of the printing machine automatically in predeterminable operating states of the printing machine.

7. The method as claimed in claim 1, wherein the adjusting devices contain cam disks rotatable manually and/or by motor, and wherein the adjustment of the instant of closure is performed by rotating the cam disks.

8. The method as claimed in claim 1, wherein the adjustment of the instant of closure is performed by varying positions of stops of the gripper devices.

9. A device for eliminating rhythmic register errors in sheet-fed printing machines with a multiple-size sheet-conveying cylinder having at least one first and one second gripper device, comprising a first cam disk assigned to the first gripper device and being rotatable by a first actuating device, and a second cam disk assigned to the second gripper device and being rotatable by a second actuating device.

10. The device as claimed in claim 9, wherein the actuating devices are formed as motorized adjusting devices, and the printing machine having a central control device for controlling the first and/or second actuating device.

11. The device as claimed in claim 9, wherein said cam disks are arranged on the same side of the sheet-conveying cylinder of the printing machine.

12. The device as claimed in claim 9, wherein said cam disks are arranged on mutually opposite sides of the sheet-conveying cylinder of the printing machine.

* * * * *